United States Patent [19]

Larsson et al.

[11] Patent Number: 4,928,622

[45] Date of Patent: May 29, 1990

[54] MACHINE FOR APPLYING ADHESIVE TO AN ELONGATE SHEET MATERIAL

[75] Inventors: Lennart Larsson, Malmö ; Arne Andersson, Dalby, both of Sweden

[73] Assignee: AB Akerlund & Rausing, Sweden

[21] Appl. No.: 303,750

[22] Filed: Jan. 27, 1989

[30] Foreign Application Priority Data

Feb. 12, 1988 [SE] Sweden ..... 88004700

[51] Int. Cl.[5] ..... B05C 1/12

[52] U.S. Cl. ..... 118/70; 118/249

[58] Field of Search ..... 118/249, 248, 70, 203

[56] References Cited

U.S. PATENT DOCUMENTS

| | | | |
|---|---|---|---|
| 2,357,824 | 9/1944 | Haywood | 118/203 |
| 2,655,865 | 10/1953 | Geiringer | 118/70 X |
| 3,029,780 | 4/1962 | Justus et al. | 118/249 X |
| 3,044,442 | 7/1962 | Pott | 118/70 X |
| 3,595,206 | 7/1971 | Larimer | 118/249 X |
| 3,919,970 | 11/1975 | Spielvogel | 118/203 |
| 4,548,840 | 10/1985 | States et al. | 118/249 X |
| 4,784,711 | 11/1988 | Larsson | 156/165 |

FOREIGN PATENT DOCUMENTS

SE447634 12/1986 Sweden .

1509961 5/1978 United Kingdom .

*Primary Examiner*—Richard L. Chiesa

*Attorney, Agent, or Firm*—Lerner, David, Littenberg, Krumholz & Mentlik

[57] ABSTRACT

A machine for applying adhesive on one side of an elongate sheet material, and comprising an adhesive containing trough (19), an adhesive application roller (20) and a driven pressure roller (21). The sheet material (15) is being passed through the nip between said rollers and the width of the rollers surpasses the width of the sheet material. The contact surface of the pressure roller (21) upon the sheet (15), consists of an endless belt (23). The belt (23) runs via at least one guide roller (24) through a trough (25), containing rinsing fluid (25). In said trough the belt (23) runs past at least one further guide roller (27), and past a brush roller (29) which is mounted in the trough (25), adjacent the outer side of the endless belt loop (23). The brush roller is being driven in counter rotation to the direction of movement of the belt. The belt then runs back to the pressure roller (21), so that the section of the endless belt loop which has been driven past the rinsing fluid trough (25) and the brush roller (29), returns to the nip free from adhesive (22).

3 Claims, 3 Drawing Sheets

MACHINE FOR APPLYING ADHESIVE TO AN ELONGATE SHEET MATERIAL

FIELD OF THE INVENTION

The present invention relates to a machine for applying adhesive on one side of an elongate sheet material which is being passed through the nip between an adhesive application roller and a driven pressure roller, and wherein the width of said rollers surpasses the width of the sheet material.

BACKGROUND OF THE INVENTION

U.S. Pat. No. 4 784 711 discloses a method for applying a surface layer onto an elongated hollow profile, wherein the surface layer is supplied to the hollow profile in the form of a plurality of strips which are glued in parallel with the longitudinal axis of said hollow profile, so that the strips overlap one another by a predetermined distance.

This method can for example be used for manufacturing a container having an inner extruded sleeve and an outer, more gas tight layer comprising a metal foil. The overlap is essential here in order to provide the required tightness. Usually, the surface layer is also used as a carrier of printed text and decorations on the container. For aesthetical reasons, it is therefore desireable to have the completed surface entirely free from adhesive spillage.

Since the laminating of sleeve and sheet material is performed at a high velocity, certain transversal sway of the sheet, at the application of adhesive, must be tolerated in the nip between the adhesive application roller and the pressure roller. There is a problem here, in that adhesive may adhere to the surface of the pressure roller, whereupon said adhesive may stain the edges of the printed text and decoration carrying side of the sheet material.

A known method for solving this problem is to cut away the outer edges of the sheet after application of adhesive and before laminating. However, this solution entails a considerable amount of sheet material wastage and the need for precise cutting means. Another solution would be to wash away adhesive from the pressure roller. However, there is an obvious risk in that rinsing fluid may pollute the adhesive in the adhesive containing trough. Such pollution may affect the barrier properties of the laminate material.

SUMMARY OF THE INVENTION

The object of the present invention is therefore to provide a machine for application of adhesive, without the risk of staining the opposite side of the sheet material.

For realizing said object, the machine comprises an adhesive containing trough, an endless belt which acts as the contact surface of the pressure roller upon the sheet, second trough means containing rinsing fluid, at least one guide roller means guiding said belt through said second trough, brush roller means which are mounted in said second trough, adjacent the outer side of the endless belt loop, said brush roller means being driven in counter rotation to the direction of movement of the belt, and further guiding means to guide the rinsed section of the belt back to the pressure roller.

According to one preferable embodiment of the invention, at least one wiping ledge contacts each side of the belt, at the belt exit from the trough.

According to another preferable embodiment of the invention, the trough is provided with an inlet and outlet for exchange of rinsing fluid.

BRIEF DESCRIPTION OF THE DRAWINGS

A preferred embodiment of the invention will now be described with reference to the accompanying drawings, in which.

DESCRIPTION OF A PREFERRED EMBODIMENT

Figure 1:
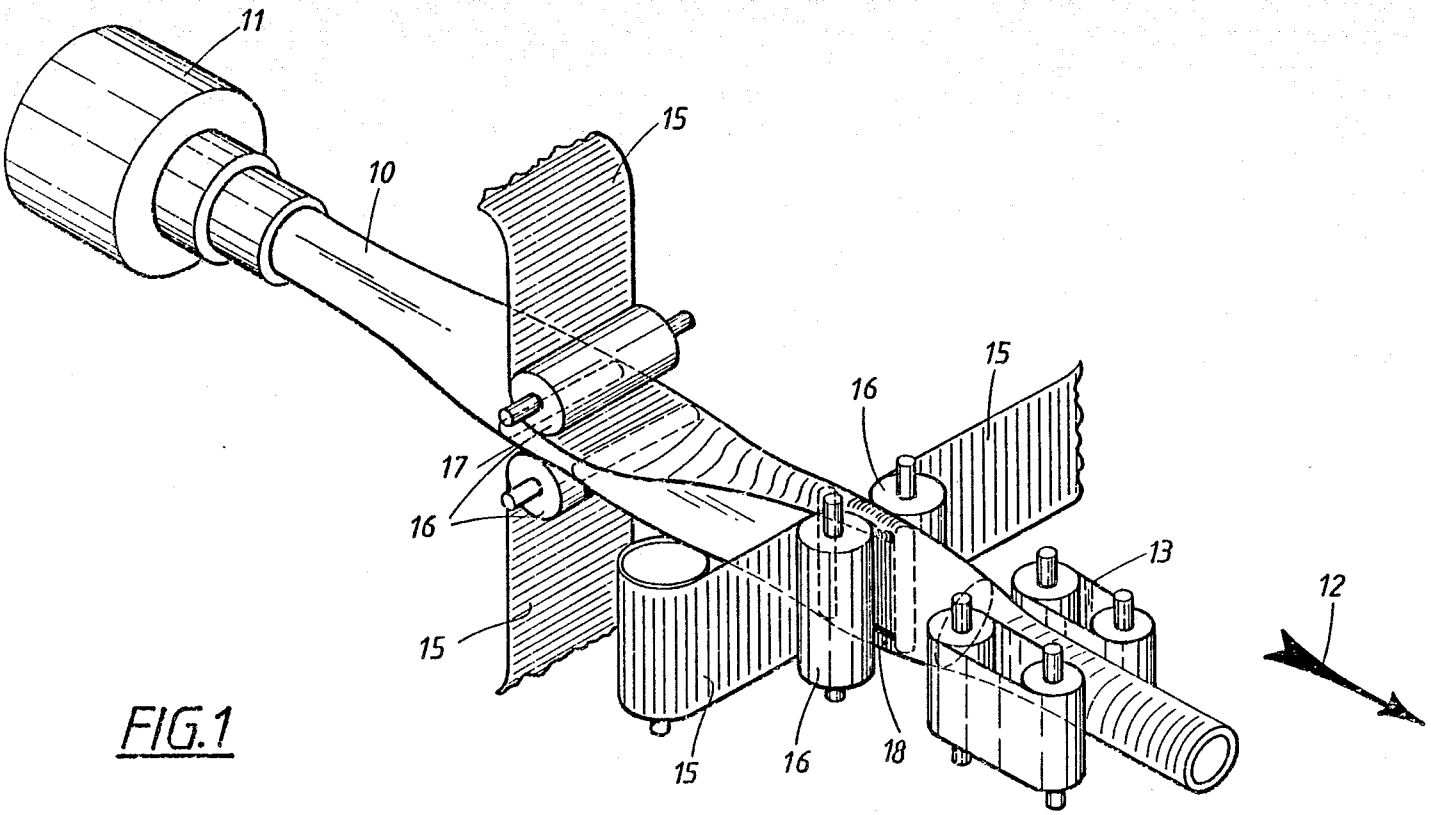
FIG. 1 diagrammatically shows the laminating of sheet material on a hollow profile, according to a possible application of the invention.

A hollow profile 10 is extruded, as FIG. 1 shows, from an extrude nozzle 11, and is pulled in the direction of the arrow 12 by means of a draw bench 13. Adhesive carrying strips 15 of sheet material are applied to the hollow profile in two steps by means of pressure rollers 16 in a first and a second station 17 and 18 respectively.

According to this prior art laminating method, each strip is wider than a quarter of the outer circumference of the hollow profile, so that each strip joint is overlapped, in order to obtain the required barrier tightness. The pressure rollers are arranged in pairs, so that the hollow profile is pressed between them from two opposite sides, wherein the respective strip is flattened. The hollow profile 10 returns to its normal cross-section after it has passed through the draw bench 13.

Figure 2:
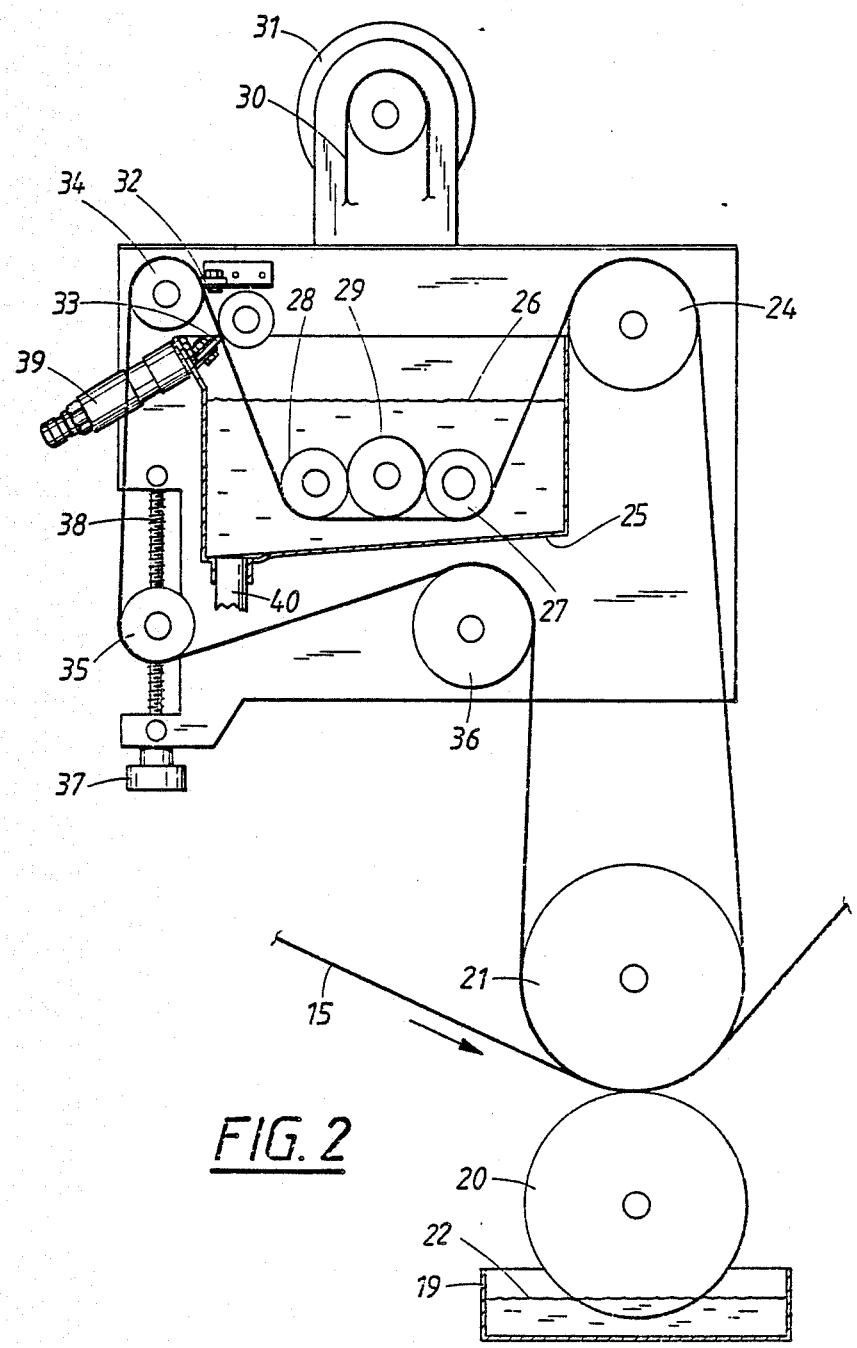
FIG. 2 is a side view, showing the machine for application of adhesive according to an application of the invention.
Figure 3:
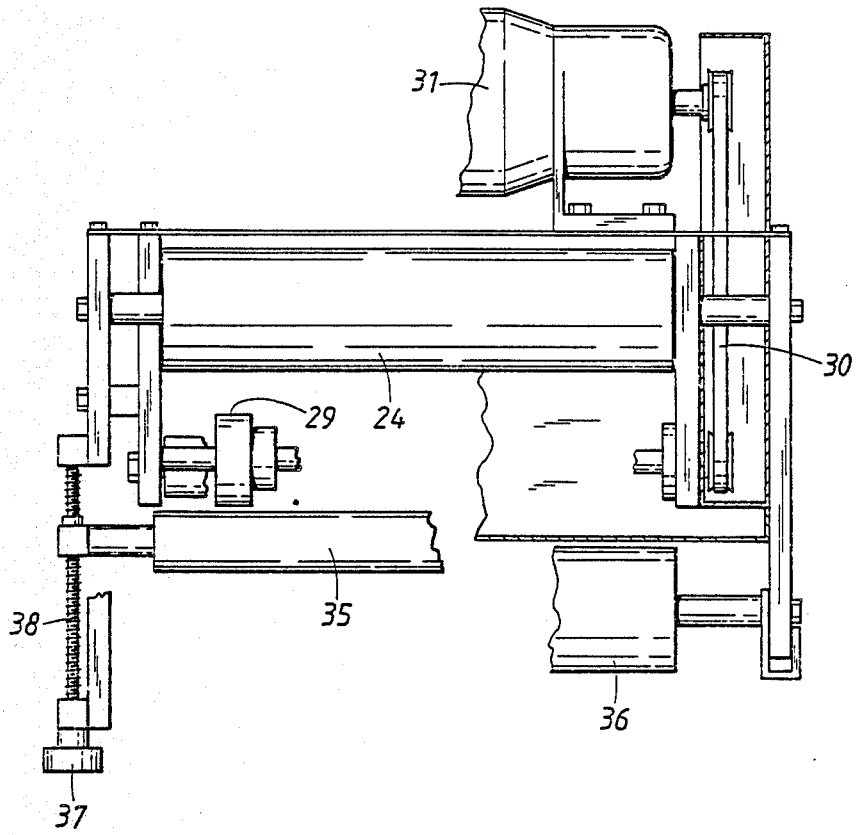
FIG. 3 is a similar view of the machine in FIG. 2, seen in the direction of movement of the belt.
Figure 4:
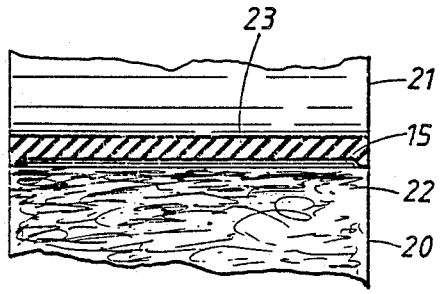
FIG. 4 shows the sheet material in the nip between adhesive application roller and pressure roller.

The application of adhesive to the strips 15 takes place by means of the machine shown in FIGS. 2 and 3, which comprises an adhesive trough 19, an adhesive application roller 20 and a driven pressure roller 21, wherein the sheet material 15 passes through the nip between said two rollers. The nip between the adhesive application roller 20 and the pressure roller 21 is shown in FIG. 4, from which it is clear that the width of the rollers surpass the width of the sheet material 15. This is a condition for maintaining a high production capacity. As a result of this difference in width, and that the rollers are slightly compressible, a transfer of adhesive 22 takes place to the outer edges of the pressure roller.

The area of contact of the pressure roller onto the strip is by means of an endless belt 23, which runs from the pressure roller via a guide roller 24 down into an open trough 25 which contains rinsing fluid 26 and means for removing adhesive from the belt.

The trough 25 is provided with rollers 27, 28 to guide the belt down into one end of the trough and up out of the opposite end of the same. A brush roller 29 is mounted between both said brush rollers 27, 28, said roller being driven by a V-belt 30 and an electric motor 31 in counter rotation to the direction of movement of the belt 23, so that the brush roller brushes the border edges of the outer side of the endless belt loop.

Wiping ledges 32, 33 are mounted at each side of the belt, at the exit side of the trough, for wiping of used rinsing fluid from the belt.

The belt loop subsequently runs via further guide rollers 34, 35 and 36 back to the pressure roller 21. The guide roller 35 is provided with means 37, 38 for adjusting the tension of the belt loop. The trough 25 is provided with an inlet 39 for fresh rinsing fluid 26, and an outlet 40 for exchange of used rinsing liquid.

The invention is not limited to the above described embodiment, but several modifications are possible within the scope of the accompanying claims. For example, it is possible to apply the adhesive 22 on the upper side of the sheet material, wherein the guiding means for the pressure roller belt loop may be simplified.

What we claim:

1. A machine for applying adhesive on one side of an elongate sheet material comprising:

an adhesive application roller having a width along a rotational axis, a driven pressure roller having a width along a rotational axis, said pressure roller disposed adjacent said application roller so that a nip is formed between said pressure roller and said application roller, means for passing the sheet material through said nip, said width of each of said application roller and said pressure roller surpassing the width of the sheet material, an adhesive containing trough disposed in spaced relation to said application roller so that said application roller extends into said adhesive containing trough, an endless belt arranged for rotation around said pressure roller, said endless belt having an outer surface acting as the contact surface of said pressure roller upon the sheet material, second trough means containing a rinsing fluid, at least one guide roller means guiding said endless belt through said second trough to rinse a section of said belt, brush roller means mounted in said second trough adjacent said outer surface of said endless belt, said brush roller means being driven in counter rotation to said direction of rotation of said endless belt, and further guiding means to guide said rinsed section of said endless belt back to said pressure roller.

2. A machine according to claim 1, wherein at least one wiping ledge contacts each side of said endless belt at a point at which said endless belt exits from said second trough.

3. A machine according to claim 2, wherein said second trough is provided with an inlet and an outlet for exchange of said rinsing fluid.

* * * * *